United States Patent [19]

Bocquet et al.

[11] Patent Number: 4,999,224

[45] Date of Patent: Mar. 12, 1991

[54] METHOD AND DEVICE FOR COATING SKI SOLES

[75] Inventors: Jean-Pierre Bocquet, La Motte Servolex; Daniel Vieau, Le Bourget du Lac, both of France

[73] Assignee: SKID, societe anonyme, La Motte Servolex, France

[21] Appl. No.: 414,189

[22] Filed: Sep. 28, 1989

[30] Foreign Application Priority Data

| | | | |
|---|---|---|---|
| Sep. 29, 1988 | [FR] | France | 88 13137 |
| Oct. 11, 1988 | [FR] | France | 88 13998 |
| Mar. 3, 1989 | [FR] | France | 89 03264 |

[51] Int. Cl.[5] ..... B05C 1/02

[52] U.S. Cl. ..... 427/356; 118/56; 118/101; 118/202; 118/207; 118/407; 401/1; 401/48; 401/137; 401/193

[58] Field of Search ..... 118/410, 413, 415, 56, 118/101, 200, 202, 207, 407, 410, 413, 415; 401/1-3, 48, 193, 137, 139; 427/356

[56] References Cited

U.S. PATENT DOCUMENTS

| | | | |
|---|---|---|---|
| 2,195,101 | 3/1940 | Swab | 118/410 |
| 2,404,582 | 7/1946 | Bosomworth | 118/413 |
| 3,968,345 | 7/1976 | Kollmeder | 280/809 |
| 4,135,651 | 1/1979 | Hession et al. | 118/415 |
| 4,245,585 | 1/1981 | Bocquet | 118/415 |

FOREIGN PATENT DOCUMENTS

| | | | |
|---|---|---|---|
| 0273743 | 3/1913 | Fed. Rep. of Germany | 118/415 |
| 2164596 | 6/1973 | Fed. Rep. of Germany . | |
| 3217152 | 11/1983 | Fed. Rep. of Germany . | |
| 2096261 | 2/1972 | France . | |
| 2243711 | 4/1975 | France . | |
| 2267807 | 11/1975 | France . | |
| 2068051 | 8/1976 | France . | |
| 2391054 | 12/1978 | France . | |
| 571877 | 1/1976 | Switzerland . | |

*Primary Examiner*—Willard E. Hoag
*Attorney, Agent, or Firm*—Ratner & Prestia

[57] ABSTRACT

A method and device are divulged for over-molding ski soles. As claimed in the invention, a thermoplastic filling material is continuously fed in solid form into a heating and spreader shoe, the material being progressively softened in the shoe and fed in liquid form under the shoe to be successively distributed, crushed, spread over the ski sole, then driven under pressure by a transverse scraper fast with the spreader shoe. The scraper is a steel bar with rectangular section whose lower edge projects slightly below the lower surface of the spreader shoe. The projection of the lower edge, the slant of its front face, the speed of movement and the bearing force are chosen appropriately.

21 Claims, 6 Drawing Sheets

METHOD AND DEVICE FOR COATING SKI SOLES

BACKGROUND OF THE INVENTION

1. Field of the Invention

The present invention relates to a method and device for molding over ski soles by sweeping them with a thermoplastic material.

The development of thermoplastic resins as coating forming the sole or sliding surface of skis has led to the development of machines for repairing or renovating such ski soles, so as to restore a surface condition free from roughness or cracks and give to such coatings the original mechanical characteristics.

2. Description of the Prior Art

Such methods and devices are known for over-molding ski soles, described for example in the patent FR-A-2 391 054. In such a known method, a thermoplastic coating material is continuously fed in solid form into a heating body, shaped as a spreader shoe, the coating material being progressively softened in the heating body and fed in liquid form under the shoe for crushing and spreading over the ski sole during the sweeping or longitudinal translational movement of the shoe on the ski. The device for implementing such a method comprises means for supplying a thermoplastic coating material, a heating body with a spreader shoe shaped so as to receive the coating material in solid form, heat it and progressively soften it, and feed it in liquid form under a distribution and spreading structure intended to be pressed against the ski sole and to be driven in longitudinal translation over said ski sole in a preferential propagation direction. The shoe comprises a projection for preheating the ski sole upstream of the distribution structure.

The material forming ski soles is generally a polyethylene. To provide an over-molding having sufficient properties of clinging to the pre-existing sole, a polyethylene is generally used as thermoplastic coating material in solid, strip, wire or granule form.

For some time, in order to increase the sliding qualities of skis, manufacturers have developed sliding soles made from a very high molecular weight polyethylene. Such ski soles are obtained by sintering and are formed by cutting. The sliding qualities thus obtained are superior to those obtained with lower molecular weight polyethylenes, such as polyethylenes molded when hot at a temperature exceeding the softening point.

It has been noted that when such a sole is over-molded with a very high molecular weight polyethylene using a known molding device, which covers said sole with a molten polyethylene film, a large part of the advantages of the initial very high molecular weight polyethylene sole is lost, and in particular its superior sliding power. Known devices in fact lead to covering the whole of the preexisting sole with a molten polyethylene film, which is then reduced by planing and sanding down.

Attempts have been made to reduce the unfavorable over-molding effects by reducing the final area of the polyethylene deposited by melting. The Applicant has thus attempted to reduce this area by subsequently machining the over-molded sole until the flat parts of very high molecular weight polyethylene appear, leaving the molten polyethylene only in the hollow zones which justified the over-molding. Such attempts have however shown that the result obtained is disappointing, for the sliding qualities of the initial sole are not recovered.

Such a method further leads to a not inconsiderable loss of material, for the known over-molding methods and devices require a thermoplastic material layer of sufficient thickness to be deposited and the greatest part of this thickness must then be removed.

SUMMARY OF THE INVENTION

The aim of the present invention is in particular to provide a method of molding over a ski sole by sweeping, making it possible to keep as much as possible the sliding qualities of the material forming the original sole, by avoiding re-coating the flat ski sole parts with thermoplastic material and sufficiently coating the hollow sole portions. The difficulty is in particular to sufficiently fill the hollow sole portions, so that hollow portions do not appear again after shrinkage of the over-molding material on cooling.

The present invention also has as object to reduce as much as possible the heating time for the very high molecular weight polyethylene forming the initial sole to be over-molded. The reduction of the heating time involves an increase in the translational speed of the over-molding device with respect to the ski sole, which speed tends to reduce the time required for over-molding and so increase the production rate.

A first attempt may consist in increasing the heating power of the resistances housed in the spreader shoe, so as to increase its temperature and increase the heating rate of the plastic filler material and of the sole to be over-molded. It has however proved that such an attempt leads to failure for it increases slightly the sweeping speed, but the deposited polyethylene layer forming a thermal pad maintains the heat too long on the ski sole. A more substantial increase in the heating power and temperature causes damage to the filler material and the production of fumes, particularly during stopping between two molding operations.

Furthermore, the aims sought by the invention must not lead to reducing the quality of the over-molding obtained, nor the distribution of the material deposited on the sole.

Another aim of the invention is to provide a semiautomatic over-molding device, providing by itself the relative transfer of the ski and of the over-molding device; according to the invention, attempts have been made to reduce the size of the device and in particular to design such a device having a size appreciably less than the length of the ski. For that, new means must be provided for holding the ski in position and transferring it at a regular speed through the device.

To attain the desired effects as well as others, in an over-molding head, the thermoplastic filling material is successively heated in heating channels, introduced in a transverse distribution groove formed in a lower face of the spreader shoe structure, crushed and spread over the ski sole by a spreader surface and, at the end of the spreading zone under the spreader shoe, the thermoplastic filling material still in viscous form is immediately driven under pressure by a transverse scraper. The operation consisting in driving under pressure must not be confused with simple scraping. During this operation, the pressure causes, it seems, a slight expulsion of filling material downstream of the scraper through the hollow portions of the surface to be over-molded and the filling material expands when it passes from the viscous and compressed condition to the solid state. The result is an extra thickness of filling polyethylene in the hollow surface zones requiring repair. This effect would not be obtained with traditional scraping.

Preferably, the transverse scraper is formed of a blade brought substantially to the temperature of the spreader shoe; the scraper is fixed to said spreader shoe.

The blade is advantageously formed of a lower sharp substantially rectilinear transverse edge separating a front face and a rear face.

During the sweeping movement, the transverse scraper can be advantageously held in position bearing in sliding relation on the lower edges of the ski, the thermoplastic filling material providing sufficient lubrication for promoting sliding between the scraper and the edges of the ski without excessive wear of the scraper and of the edges.

The over-molding head of the present invention has substantially the structure of the device described in patent FR-A-2 391 054 and further comprises, downstream of the distribution zone, a transverse scraper adapted for scraping the filling material, still in liquid form over the ski sole.

The transverse scraper is preferably a blade made from a heat conducting material and is subjected to the action of heating means bringing it to a temperature at least equal to the softening temperature of the filling material.

A blade may be advantageously used in the form of a steel bar with rectangular section, fastened to the spreader shoe and thus driven in translation and heated by the spreader shoe. One of the edges of the steel bar forms the lower sharp edge which projects below the distribution and spreading surface of the shoe.

It has been found that the result may be appreciably improved on the one hand by substantially increasing the translational speed but further by simultaneously and appropriately adjusting several of the shape parameters of the heating and spreading shoe.

For that, in an advantageous embodiment, the projecting edge of the scraper projects below the distribution and spreading surface of the shoe over a height between two and four tenths of a millimeter. Further, the front scraper face forms, with the distribution and spreading surface of the shoe, an angle between one hundred and five and one hundred and thirty-five degrees, advantageously about one hundred and twenty degrees.

Tests have shown that a sufficient pressure must be applied by the shoe on the thermoplastic filling material in the zone situated between the shoe and the sole to be over-molded. To apply such a pressure, which must be controlled, the shoe may be advantageously associated with a fixed frame structure comprising means for supporting the shoe and the ski to be over-molded, means for driving the shoe and the ski in relative longitudinal translation and means for holding the shoe applied with a given force against the ski sole: during the longitudinal translational movement. The bearing force applied on the shoe is advantageously between two hundred and five hundred Newtons, the translational speed being advantageously between 3 and 4 meters per minute.

In an advantageous embodiment, the over-molding head is mounted for swinging on a transverse shaft fixed to a presser bar connected to the frame, whereas the ski support is movable and driven in longitudinal translation. The ski support comprises a movable and removable straddle carrier comprising a rectilinear beam associated with wedges and with ski holding means. The external surface of the rectilinear beam forms a bearing surface, opposite the surface to be machined of the ski, over which rolls a drive roller with transverse rotational shaft driven by a motor and mounted on the frame. Presser means produce an appropriate pressure for holding the over-molding head applied against the ski. The rotational shaft of the roller is advantageously disposed in the mean vertical transverse plane of the over-molding head. Thus, the roller and the compression force of the over-molding head are opposed with respect to the assembly formed by the ski and the straddle carrier and are situated in the same vertical transverse plane.

Preferably, the bearing surface of the straddle carrier comprises notches cooperating with corresponding notches formed on the surface of the drive roller.

BRIEF DESCRIPTION OF THE DRAWINGS

Other objects, features and advantages of the present invention will be clear from the following description of a particular embodiment, with reference to the accompanying figures in which.

DESCRIPTION OF THE PREFERRED EMBODIMENTS

Figure 1:
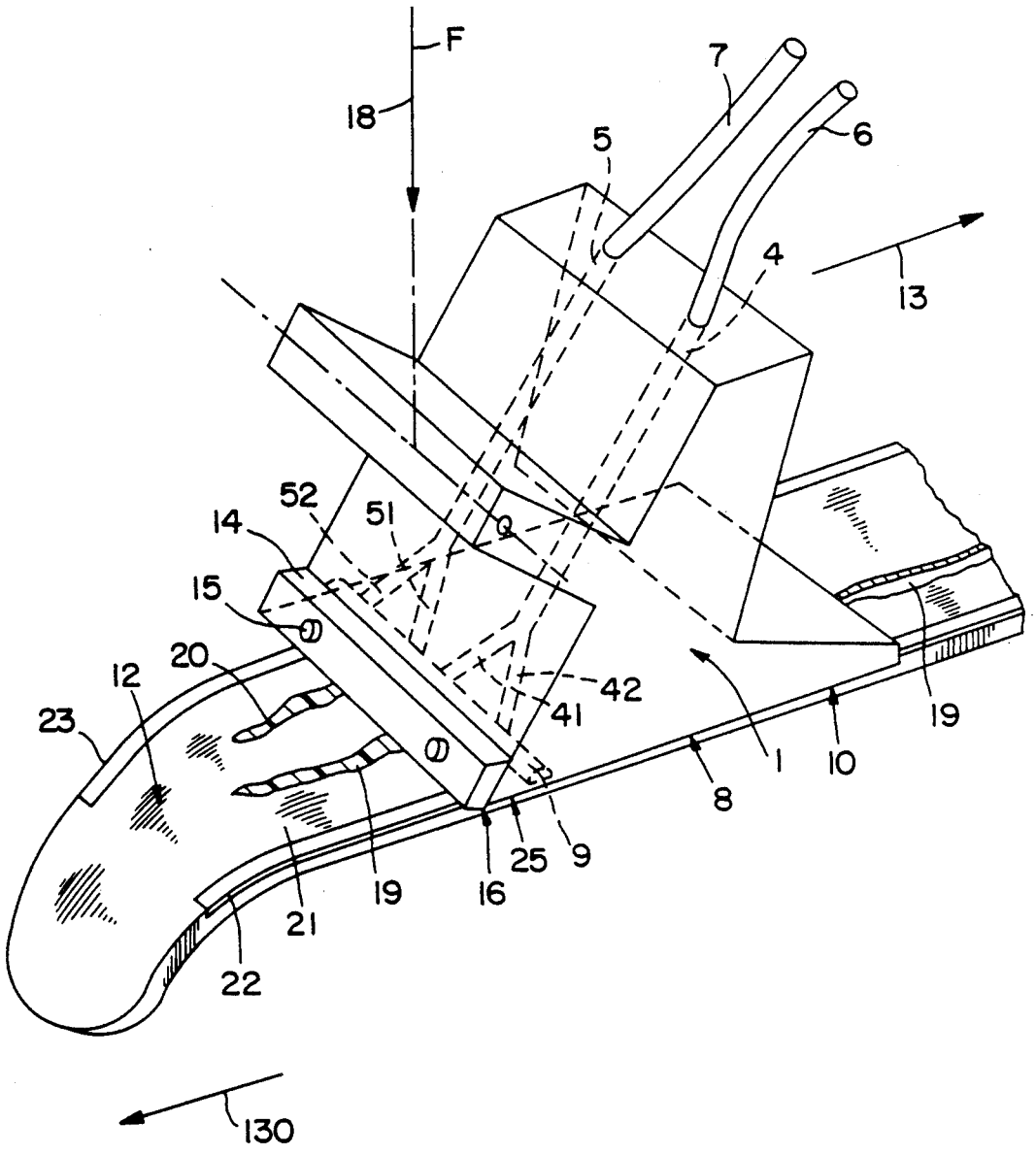
FIG. 1 is a schematic perspective view of an over-molding head according to the present invention, in operation on a ski sole to be over-molded.
Figure 2:
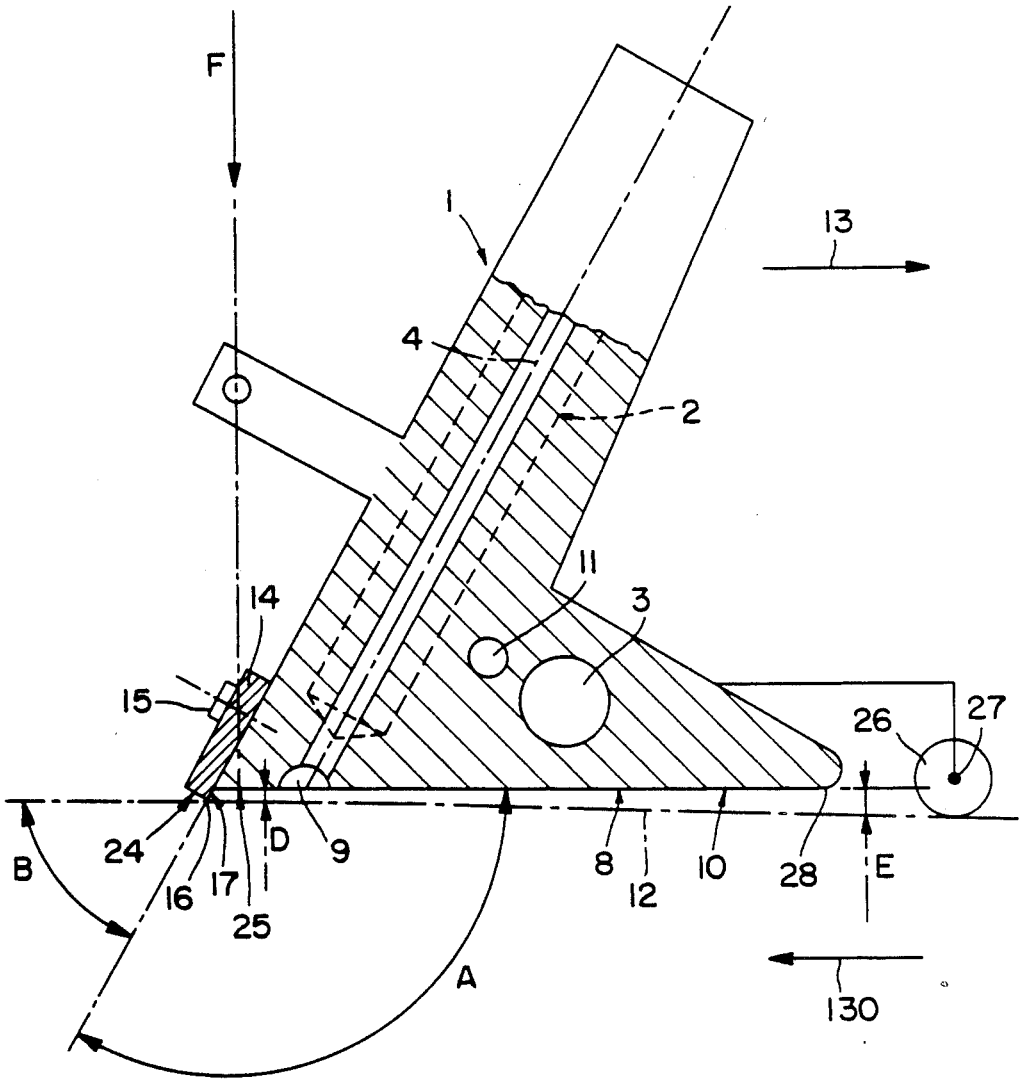
FIG. 2 is a side view in longitudinal section of an over-molding head according to the present invention.

The over-molding head of the present invention, shown schematically in FIGS. 1 and 2, comprises essentially a heating body, generally referenced at 1, made from a heat conducting metal in which heating cartridges are housed such as cartridges 2 and 3 containing spaced apart electric resistances. The heating cartridges 2 and 3 are distributed in the heating body so as to provide an appropriate distribution of the temperature in the heating body. The central part of the heating body, in operation, is brought to a temperature between 320° C. and 340° C., advantageously about 330° C. The heating body 1 has extrusion conduits passing therethrough from one end to the other such as conduit 4. Two extrusion conduits 4 and 5 may for example be provided whose upper portions are substantially parallel. The upper end of the extrusion conduits is adapted so as to receive the filling material in solid form. For example, the filling material may be in the form of a polyethylene wire, or two polyethylene wires referenced generally at 6 and 7, coming from reels not shown in the figures. Mechanical drive means, not shown in the figures, such as separated rollers driven by a motor and between which the solid filling material is engaged, force the thermoplastic filling material inside the extrusion conduits 4 and 5 in the direction of the lower end of the extrusion conduits.

In a first embodiment, the extrusion conduits 4 and 5 are each divided into two lower branches, respectively 41, 42, 51, 52 which open, in the lower face 8 of the heating body, into a transverse distribution groove 9. The orifices of the four lower branches 41, 42, 51, 52 occupy positions spaced evenly apart over the length of the groove and cut said length into four substantially equal sections.

In an advantageous embodiment, the external branches 42 and 52 may be omitted and only the oblique and convergent internal branches 41 and 51 kept, which open into the transverse groove 9 through two orifices spaced apart by about 15 millimeters. The filling material is thus driven more slowly towards the edges of the surface to be over-molded. The lower face 8 of the heating body 1 is flat. In the lower portion, the heating body 1 widens out in a first direction which is longitudinal with respect to the transverse distribution groove 9 so as to form a preheating shoe. The lower flat face 8 is extended under the pre-heating shoe and forms a front zone 10 or surface for pre-heating the ski sole. The lower front portion 8 opposite the pre-heating shoe with respect to the transverse groove 9 forms the spreading zone 25.

The transverse distribution zone 9 is closed at both its ends so as to prevent the filling material from flowing too rapidly at the ends. Its length is between about 90 and 100 mm, its width between about 4 and 7 mm, its depth between about 2 and 3.5 mm. Advantageously, a length of about 95 mm, a width of about 6 mm and a depth of about 3 mm may be chosen.

The heating body 1, as well as the mechanical drive means for the solid material, are contained in a case which is not shown in the figures, providing protection and heat insulation from the heating body, only the lower face 8 of the heating body being visible and accessible.

A temperature sensor 11 is housed in the heating body 1 and is associated with temperature regulation means for maintaining , during operation, the temperature of the heating body 1 at a given appropriate value for melting the thermoplastic filling material in the extrusion conduits 4 and 5.

The over-molding head is intended to be applied on a ski sole 12 with its lower face 8 substantially parallel to the sole surface, and be moved longitudinally over said sole in a preferential direction of movement shown by arrow 13, i.e. the direction of movement towards the preheating shoe. An advantageous arrangement consists of mechanical means permitting the ski to move in the opposite direction illustrated by arrow 130, the heating body remaining fixed in a longitudinal position and being possibly articulated and driven by holding and bearing means producing the bearing force F. Thus, with respect to the transverse distribution groove 9, the upstream zone of the heating body 1 is defined, comprising the front zone 10 and the downstream zone of the heating body 1 or spreading zone 25.

Downstream of the spreading zone 25, heating body 1 comprises a transverse scraper 14 adapted so as to scrape the filling material still in viscous form over the ski sole 12. In the embodiment shown, scraper 14 is a steel bar with rectangular section, slanted by thirty degrees or so with respect to the perpendicular to the lower face 8 of the heating body 1, and is fixed on the rear face of the heating body by fixing screws 15. Because of its slant, the bar has a lower transverse sharp edge 16 formed by a front face 17 of the scraper and a rear face 24 of the scraper. The lower edge 16 of the bar forming scraper 14 projects slightly below the lower face 8 of the heating body 1. The value of projection D is advantageously between two and four tenths of a millimeter. Because of the slant of the bar forming scraper 14, the front face 17 of the bar forms, with the lower face 8 of the heating body 1, an angle A between one hundred and five and one hundred and thirty-five degrees and forms, with the sole surface to be over-molded, an angle B between forty-five degrees and seventy-five degrees. An angle A may be advantageously chosen of one hundred and twenty degrees, and so an angle B of 60°. Such a slant produces a wedge effect and a driving effect which promotes penetration of the thermoplastic material into the slits and other hollow portions of the sole to be over-molded. An angle B greater than about 75° produces chattering phenomena. An angle B less than 45° reduces the driving effect too much and results in a simple crushing effect which is less favorable. Excellent results have been obtained with an angle B between 55° and 65° and so an angle A between 115° and 125°.

In the embodiment shown, scraper 14 is formed of a removable and interchangeable blade, which may also be adjusted for modifying at will the projection D of the lower edge 16 below the lower face 8 of the heating body 1. Without departing from the scope of the present invention, however, a scraper 14 may be provided fixed permanently on the heating body 1, without any possibility of adjustment.

The operation of the device according to the present invention, for obtaining selective over-molding limited to the damaged surface zones, is improved by applying a sufficient force F on heating body 1 in the direction of the ski sole, oriented substantially vertically of the spreading zone 25, as shown by the arrow 18. For an appliance intended to cover the whole width of the ski, force F is generally between 200 and 500 Newtons. Such a force F, advantageously from about 200 to 250 Newtons, may be produced manually by the operator. Preferably, the force F may be produced by a mechanical means, making it possible to maintain and control the application and direction of this force and to adjust it to an adequate value for obtaining a regular result. The over-molding head is, for that, associated with support means supporting both the over-molding head and the ski to be over-molded. Mechanical means drive the over-molding head and ski 12 in relative longitudinal translation at a speed V advantageously between 3 and 4 meters per minute and mechanical means maintain the heating body 1 applied with the given force F against the ski sole against its lower face 8, as shown in FIG. 1. The mechanical drive means for the filling material provide a continuous and regular supply of polyethylene, at a rate sufficient for filling the hollow zones of ski sole 12 with a slight excess.

For an appliance intended to cover a portion of the width of the ski, for example half the width, force F may be reduced proportionally. Such an appliance may be more readily handled and operated by hand, without requiring mechanical means for producing force F. A drive roller may however assist the operator for producing the smooth advance of the appliance over the ski sole in the direction of arrow 13.

During operation, the heating body 1 is held applied against the ski sole 12 by applying the force F required and said heating body 1 and the ski are driven in relative translation, for example the ski in the direction shown by arrow 130 with respect to a fixed heating body 1. The heating body 1 is kept at an appropriate temperature for melting the thermoplastic material 6, 7 introduced into the extrusion conduits 4 and 5, the filling material being progressively softened in the heating body and fed in liquid form under the heating body and distributed in the transverse distribution groove 9. The lower flat face 8 of the heating body 1 provides preheating of the sole portion 12 situated upstream under the front zone 10, then crushing and spreading of the filling material by the spreading zone 25. At the end of the spreading zone 25, the thermoplastic filling material, still in viscous form, is driven under pressure by the transverse scraper 14. During operation, scraper 14 is applied slidingly against the lower edges 22 and 23 of the ski. Good results are obtained by using a lower face 8 of heating body 1 whose total length is between about 90 and 110 mm, so that preheating of the sole to be over-molded is sufficient.

The relative position of the lower face 8 of heating body 1 and of sole 12 of the ski must be advantageously held constant during the over-molding operation. Preferably, the lower face 8 should be slightly detached from the sole 12 to be over-molded of the ski, so that the only contact with the sole is provided by the scraper. For that, a front roller 26 is provided mounted for free rotation on a transverse shaft 27 secured to fixing means not shown of the heating body 1, such that the front end 28 of the lower face 8 is separated from the ski sole 12 by a space E advantageously between 1 and 3 mm, for example 2 mm. Space E prevents the surface to be over-molded from coming into contact with portions of the lower heating face 8, as a function of the cambers of the ski, which might disturb the efficiency of scraper 14, by reducing force F.

In the case of an appliance actuated manually, roller 26 may be advantageously motorized.

Using the method and device according to the present invention, selective over-molding can be obtained with thermoplastic material filling the hollow zones of the sole 12 to be over-molded; which zones have been shown under the references 19 and 20 in FIG. 1, whereas the flat zones such as zone 21 of sole 12 retain practically no over-molding material. In the hollow zones 19 and 20, after cooling, the thermoplastic filling material forms a slight overthickness above the generally flat surface of sole 12. It is then sufficient, with subsequent slight scraping, sanding down or grinding, to reduce the overthickness and thus obtain an even sole surface in which the thermoplastic filling material is limited to the hollow zones alone which require repairing.

Good results have been obtained particularly with a filling polyethylene sold commercially under the trademark LAFIX. Other materials may however be used and lead to satisfactory results, namely selective over-molding with extra thickness in the hollow zones of the sole.

Using the method of the present invention, the flat zones 21 of sole 12, formed of a very high molecular weight polyethylene, are not damaged by the heat applied by the heating body 1 or the over-molding material during their passage and keep their superior sliding properties. In fact, with the method of the invention, there is no need to superimpose a film of hot filling material on the flat zones 21 of sole 12, which film heats the sole by conduction and causes it to lose the properties proper to sintered polyethylene.

Figure 3:
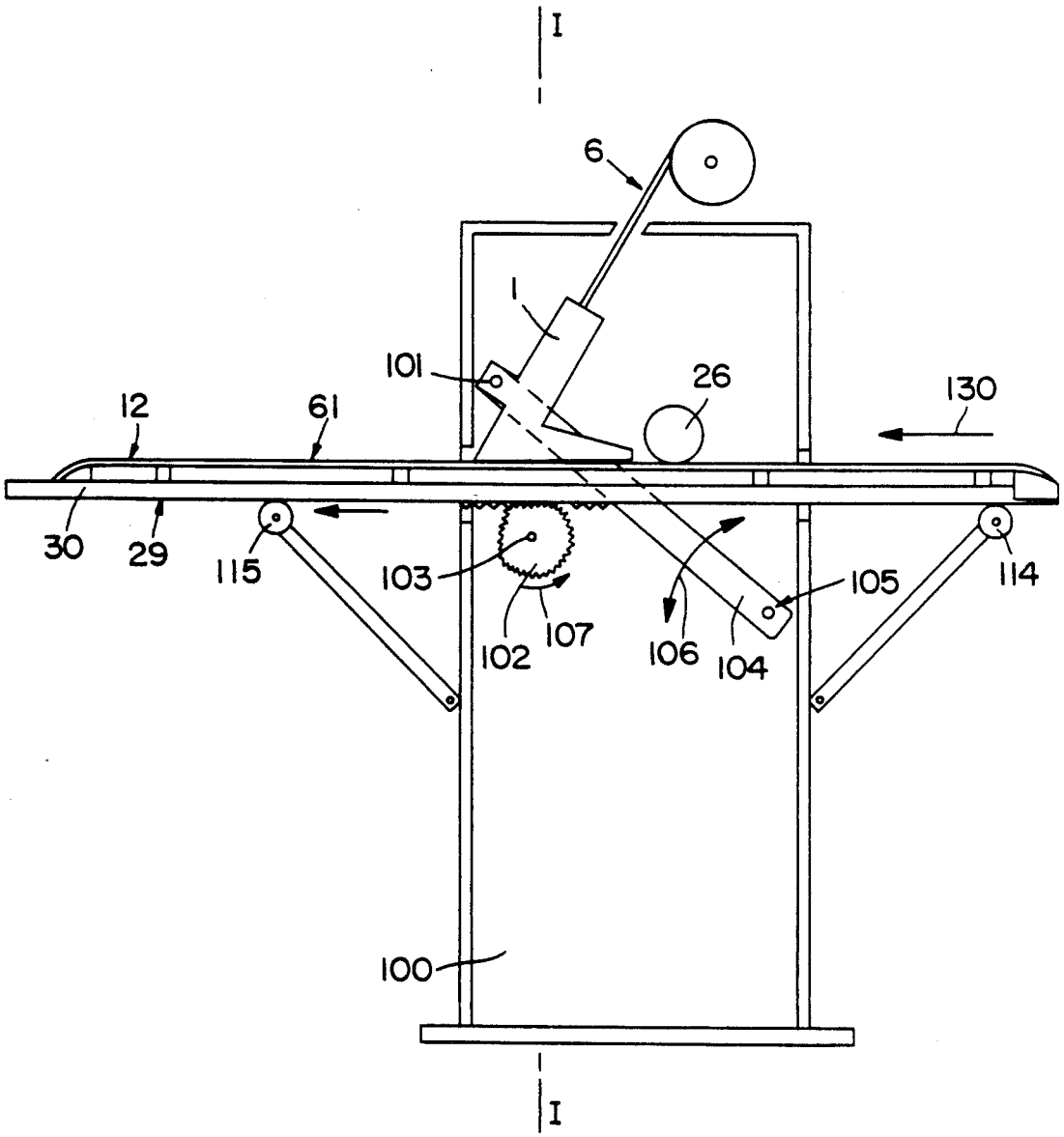
FIG. 3 is a front view, in partial section, of an over-molding device according to the present invention comprising an over-molding head and means for holding the ski in position.
Figure 5:
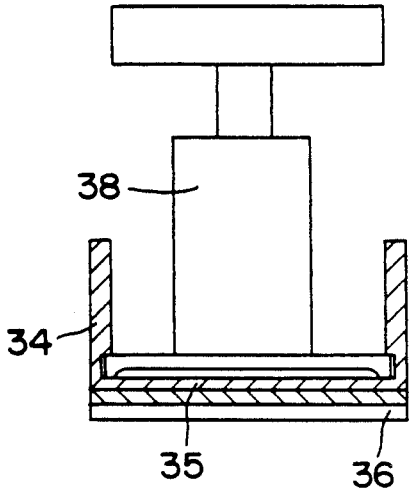
FIG. 5 is a cross section through plane C—C of FIG. 4.
Figure 4:
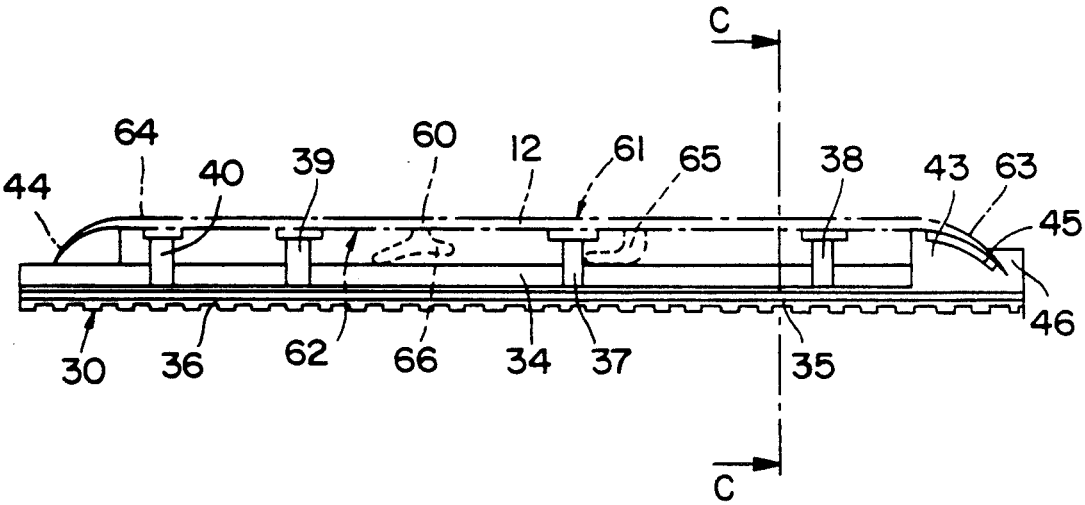
FIG. 4 is a longitudinal section of a ski straddle carrier according to the present invention.
Figure 6:
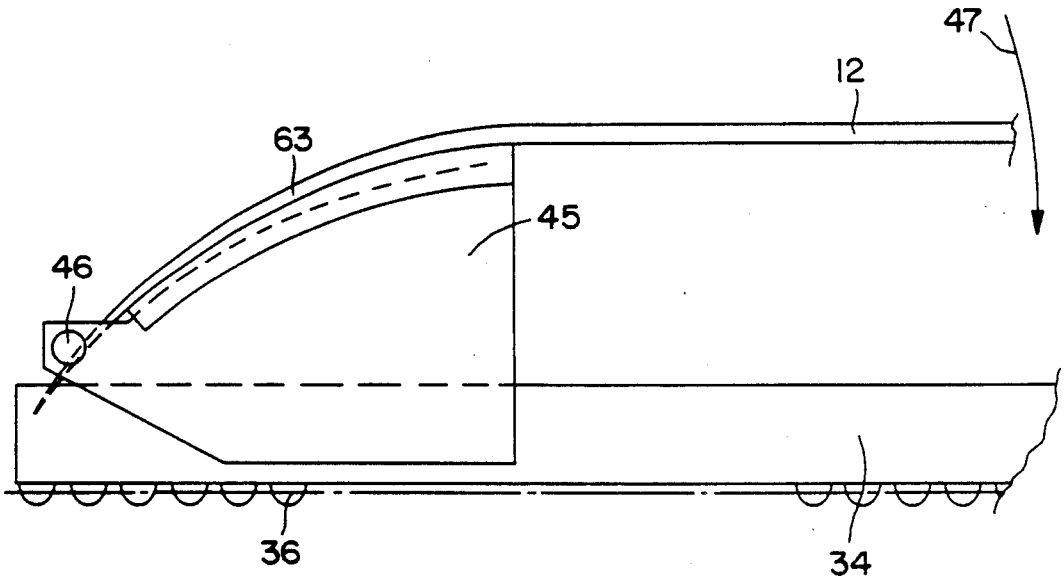
FIG. 6 shows, in a front view, the detail of the connecting means between the straddle carrier and the tip of a ski.
Figure 7:
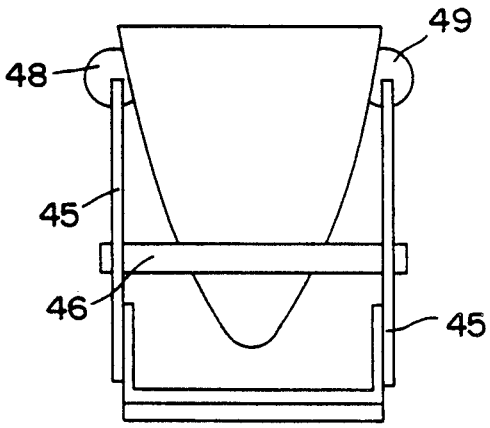
FIG. 7 shows the same connecting means in an end view.

In FIG. 3, a general view has been shown of an advantageous embodiment of the device of the invention. The device comprises a fixed frame 100 carrying the over-molding head. Drive means are provided for driving the ski 12 in longitudinal translation.

The heating body 1 is mounted for swinging on the transverse shaft 101 of a support arm 104 pivoting on a shaft 105 fixed to frame 100, whereas the ski 12 is driven in translation by support means 30 and 102 in a preferential direction shown by arrow 130. The pivoting movements are shown by the double arrow 106 and make it possible to move the over-molding head 1 towards and away from a drive roller. In the description and claims, the relative direction of movement 130 of ski 12 defines the longitudinal direction; the transverse direction is a horizontal perpendicular to the longitudinal direction. The support means comprise a straddle carrier 30, fast with ski 12, and driven by a drive roller 102 mounted for rotation on a transverse motor-driven shaft 103. The rotational shaft 103 of drive roller 102 is disposed substantially in a vertical transverse plane I—I passing through the middle of the over-molding head 1. The assembly formed by the straddle carrier 30 and ski 12 is inserted for translational movement between the drive roller 102 and the over-molding head 1. The over-molding head 1 bears on the sliding surface 61 of the ski, whereas the drive roller 102 bears on the flat or notched external face 29 of the straddle carrier 30.

During their travel between the drive roller 102 and the over-molding head 1, ski 12 and straddle carrier 30 may be further held in position by an upstream support roller 114 and a downstream support roller 115, disposed respectively upstream and downstream of the over-molding head, as shown in the figure, and rotating respectively on horizontal shafts carried by frame 100. The support rollers 114 and 115 are disposed in a substantially horizontal plane passing through the contact generatrix of the drive roller 102.

The drive roller 102 is rotated, in the direction shown by arrow 107, by a motor which is not shown in the figures. The presser arm 104 is urged by a spring or a jack such as a gas-powered jack, not shown in the figures, applying the over-molding head 1 against the sliding face 61 of the ski mounted on the straddle carrier 30 in the direction of the drive roller 102.

In the embodiment shown in FIGS. 3 to 8, the straddle carrier 30 is adapted so as to compensate for the natural irregularities of the shape of ski 12. The straddle carrier 30 must adapt itself to the shape of traditional skis, which comprise an elongate ski body 60 of flattened shape, defined by the sliding face 61, by the upper face 62 and by two lateral edges. The front end of body 60 is curved upwards so as to form a tip 63 and its rear end is curved slightly upwards to form a heel 64. Body 60 has a thickness which is variable depending on the longitudinal position considered along the ski, the thickness being greater in the central portion of body 60 than towards the ends of the ski. The upper face 62 receives the bindings 65 and 66 for fitting a ski shoe and holding it in position, when the ski is used on snow. Body 60 is cambered so that, when the ski is laid with its lower sliding face 61 on a flat surface, it rests along two lines situated in the vicinity of the ends of the ski, the central part of sliding face 61 being raised with respect to the flat support.

So that it can be adapted to these particular shapes, the straddle carrier 30 comprises a rectilinear longitudinal beam 34 of a general U section, its external face 35 receiving a notched travelling band 36. Beam 34 comprises sliding wedges such as wedge 37. A wedge 37 may for example be provided disposed in the vicinity of the front binding 65, a wedge 38 disposed in front of wedge 37, two wedges 39 and 40 close to the rear end of beam 34. The wedges may be adjusted in longitudinal position along beam 34 by sliding, for example in a structure shown schematically in cross section in FIG. 5. Wedges 37, 38, 39, 40 have adjustable heights and are chosen so that, when the ski is in an over-molding position such as shown in FIG. 3, the wedges compensate for the camber of the ski and tend to make its sliding face 61 to be over-molded substantially flat and parallel to the external surface 35 of beam 34.

Different means may be used for securing ski 12 and straddle carrier 30 together. In the embodiment shown in FIGS. 4 to 7, fastening is provided by means 43 for securing the tip 63, means 44 for securing the heel 64 and means for securing an intermediate part of the ski body. The intermediate portion of the ski body may be advantageously secured by the intermediate wedge 37, adapted to fit under the wings of the front binding 65 of the ski. Such fitment prevents ski 12 and straddle carrier 30 from being separated by a simple translational movement perpendicular to the sliding surface of the ski. Thus, the ski-straddle carrier assembly may be handled by the ski alone, without the danger of the ski being separated from the straddle carrier.

The means 43 for securing the tip comprise a transverse holding spacer 46 connecting together two lateral bearing flanges 45 shaped substantially to the profile of tip 63 and having shoes 48 and 49. The shoes and the flanges are fast with beam 34 and disposed, as shown in the figures, so that the tip 63 may be engaged between the flanges 45 and the holding spacer 46 and so that, when the tip is thus engaged and the heel of the ski is lowered as shown by arrow 47 in FIG. 6, the tip 63 is jammed by bearing against the upper face of shoes 48 and 49 and is immobilized under the lower face of the holding spacer 46. The bearing flanges 45 are advantageously provided with flexible shoes 48 and 49 forming a flexible and resilient support for the corresponding face of tip 63.

Figure 8:
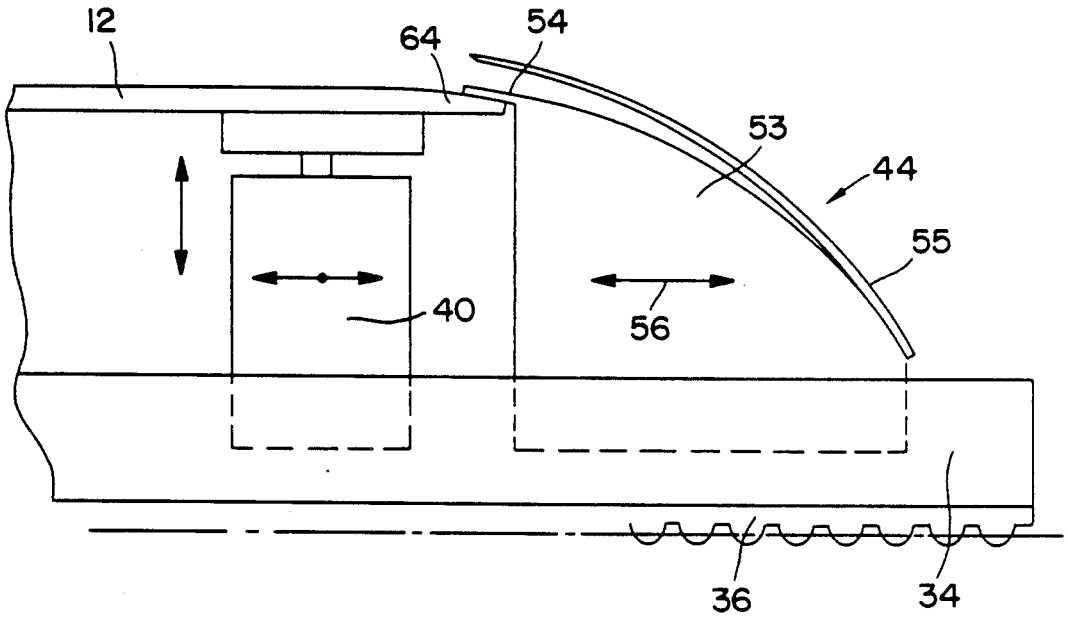
FIG. 8 shows, in a front view, the detail of construction of the connecting means between the ski heel and the straddle carrier.

The means 44 for securing heel 64, better seen in FIG. 8, comprise a rear wrap-round stop 53, comprising a projecting portion 54 under which is engaged a short length of heel 64. The rear stop 53 is rounded so as to form a ramp for progressive advance of the over-molding head on the ski. The curvature of the stop 53 should be adapted so that the over-molding shoe 1 alone is applied, without the blade of the scraper coming into abutment against this stop. Such a bearing force could in fact damage the blade. A thin metal sheet 55 is superimposed on the rounded shape of the rear stop 53. The metal sheet 55 has a dual role : first of all it wipes the initial flow of polyethylene leaving the over-molding head; this initial flow generally comprises relatively carbonized polyethylene unfit for molding, the material which forms it having waited in the heating body and been heated during the cycle interruptions. The thin metal sheet 55, for example made from copper, also makes possible the correct connection of the over-molding sole with different forms of ski heels, promoting, by being slightly deformed, a clean start to over-molding of the heel. The rear stop 53 is movable longitudinally as shown by the double arrow 56, for positioning the device : when the ski 12 is in position, with heel 64 in position, stop 53 is advanced so that its advanced portion 54 partially covers heel 64. The intermediate wedge 40, adjustable in longitudinal position and in height, provides, in cooperation with the rear stop 53, good locking of heel 64.

The ski 12 and the straddle carrier 30 thus form a one-piece assembly, the ski being applied against the straddle carrier during introduction between the drive roller 102 and the over-molding head 1, with the heel in front, in the longitudinal direction shown by arrow 130. Rotation of roller 102, in the direction shown by arrow 107, drives the assembly formed by the ski 12 and straddle carrier 30 at an appropriate regular translational speed, the sliding surface 61 of the ski being applied against the heating and spreading shoe, the drive roller 102 being applied against the external face 29 of the driver. The drive roller 102 may advantageously be provided, at its periphery, with transverse notches complementary to the notches of the travelling strip 36. Thus sliding is avoided between the drive roller 102 and the straddle carrier 30, so that the latter is driven smoothly at a regular speed.

The straddle carrier device of the invention also has the advantage of facilitating subsequent processing of the ski after over-molding. In fact, after over-molding, the ski is generally brought to an abrasive strip or stone sander. The most modern sanders have an automatic driver. The straddle carrier is adapted for passing also through such drivers. The result is that it is then no longer necessary to move the ski from one work station to another and a device may be provided comprising an over-molding head followed by a sander, the two operations being effected one after the other by a single translational movement of the straddle carrier and the ski.

In an advantageous embodiment, the device of the invention further comprises means for adjusting the speed of the motor driving the solid filler material for introduction thereof into the heating body 1, associated with means for adjusting the bearing force F. The adjustment may be simultaneous using a single control member. These means, by increasing the flow of filling material, for example by 50% and by simultaneously reducing the bearing force F, for example by fixing it at about 150 Newtons, make it possible to reduce substantially the driving effect of scraper 14 and to deposit more filling material on the ski. This adjustment may be useful when the heel and the tip of the ski are concave, complete over-molding then causing this concavity to be filled and an adjusted sole restored.

The present invention is not limited to the embodiments which have been explicitly described but includes the different variants and generalizations thereof contained within the scope of the following claims.

We claim:

1. A method of coating a ski sole comprising:

continuously feeding a thermoplastic filling material in solid form into a heating body formed as a spreader shoe;

progressively softening the filling material in the body;

bringing the filling material in liquid form to a transverse groove under the shoe;

distributing the filling material in the transverse groove under the shoe;

spreading the filling material over the ski sole by moving the spreader shoe with respect to the ski surface at a controlled speed so that, at the end of the spreading zone, the thermoplastic material remains sufficiently viscous to allow spreading; and driving the filling material under pressure by a transverse scraper wherein the scraper comprises a sharp, transverse, substantially rectilinear edge separating a front scraper face and a rear scraper face, said front scraper face forming an angle between 45 and 75 degrees with the ski surface.

2. A method as claimed in claim 1 further comprising bringing a blade of the transverse scraper, which blade is fast with the spreader shoe, to the temperature of the spreader shoe.

3. A method as claimed in claim 1, wherein, during movement, the transverse scraper bears slidingly on the edges of the ski.

4. A method as claimed in claim 1, wherein the step of driving the filling material is effectively achieved and a chattering phenomena avoided by holding the front scraper face slanted with respect to the ski sole so as to form a corner whose opening angle is kept substantially constant and between about 75° and 45°.

5. A method as claimed in claim 3 further comprising:

applying a given bearing force of between 200 and 500 Newtons to the spreader shoe in the direction of the ski sole and substantially vertically from the spreading zone;

aligning the sharp scraper edge so that it projects below the spreader shoe surface with a projection between about 2 and 4 tenths of a millimeter; and setting the speed between about 3 and 4 meters per minute.

6. A method as claimed in claim 5, wherein the angle is between 65° and 55°.

7. A method as claimed in claim 5, wherein said bearing force is between 200 and 250 Newtons.

8. A device for coating a ski sole comprising:

a heating and spreader shoe formed so as to receive thermoplastic filling material in solid form for heating it, progressively softening it, and delivering it in liquid form to a ski sole;

means for supplying said thermoplastic filling material to said heating and spreader shoe;

a distribution and spreading structure located on the bottom of the heating and spreader shoe for receiving the liquid filling material from the shoe and intended to be pressed against the ski sole and driven in relative longitudinal translation over said ski sole in a preferential propagation direction;

a lower, generally flat distribution surface on the distribution and spreading structure comprising a front zone for pre-heating the ski sole, followed by a transverse distribution groove into which the molten filling material is fed, itself followed by a spreading zone; and a transverse scraper, fast with the spreader shoe and positioned downstream of the spreading zone, having a substantially rectilinear, transverse, sharp, lower edge projecting below the distribution and spreading structure of the shoe and separating a front scraper face and a read scraper face, for scraping the filling material which remains sufficiently viscous to allow spreading over the ski sole, said front scraper face being positioned to form an angle between 45 and 75 degrees with the ski surface.

9. A device as claimed in claim 8, wherein the lower edge of the transverse scraper projects below the distribution and spreading surface of the shoe by a height between 2 and 4 tenths of a millimeter and the front scraper face forms, with the distribution and spreading surface of the shoe, an angle A between one hundred and five and one hundred and thirty-five degrees.

10. A device as claimed in claim 8, wherein the spreader shoe has electric resistance heating means distributed in its central part and conferring on said central part a temperature between 320° and 340° C. and the distribution surface has a length, parallel to the direction of ski or shoe movement, between 90 and 110 mm.

11. A device as claimed in claim 8, further comprising a front roller mounted on a transverse shaft fast with the heating body and disposed so as to maintain a constant space between the front end of the lower face and the surface to be coated.

12. A device as claimed in claim 8, wherein the front scraper face forms, with the distribution and spreading surface of the shoe, an angle A between about one hundred and fifteen and one hundred and twenty-five degrees.

13. Device as claimed in claim 8, wherein the transverse distribution groove is closed at both ends and has a length between 90 and 100 mm, a width between 4 and 7 mm and a depth between 2 and 3.5 mm.

14. Device as claimed in claim 13, wherein the transverse groove has substantially the dimensions: length 95 mm, width 6 mm, depth 3 mm.

15. A device as claimed in claim 8, wherein the spreader shoe is associated with a fixed frame structure comprising means for supporting the spreader shoe and the ski to be coated, means for driving the spreader shoe and the ski in relative longitudinal translation, and means for maintaining the spreader shoe applied with a given force against the ski sole during the longitudinal translation movement, said bearing force being between 200 and 500 Newtons, the translational speed being between 3 and 4 meters per minute.

16. A device as claimed in claim 15 including:

means for moving the ski support means in longitudinal translation over the frame;

the ski support means comprises a removable straddle carrier comprising a rectilinear beam associated with wedges and means for fixing the ski to the support;

the rectilinear beam forms a bearing surface, opposite the ski surface to be machined and over which rolls a motor-driven drive roller; and means for pressing produce an appropriate pressure on the coating head for maintaining the ski on the beam in abutment against the drive roller.

17. Device as claimed in claim 16, wherein the wedges have different lengths and are chosen so that they compensate for the chamber of the ski and tend to make the sliding surface of the ski flat during its passage through the device.

18. Device as claimed in claim 16, wherein the bearing surface of the straddle carrier comprises notches cooperating with the corresponding external notched surface of the drive roller.

19. Device as claimed in claim 16, wherein the presser means are springs or a gas driven jack producing a force of about 250 Newtons.

20. Device as claimed in claim 16, wherein the straddle carrier comprises a device for locking the ski tip, a device for locking the heel and means for locking the ski in an intermediate zone.

21. A device as claimed in claim 17, further comprising:

means for adjusting the speed of the solid filling material supply means, permitting a speed increase of about 50%, and means for adjusting the bearing force permitting a reduction of the force to about 150 Newtons, so as to make it possible to carry out at will, using the same device, selective coating in damaged zones and complete coating in the concave zones of the ski sole.

* * * * *